US011981000B2

(12) United States Patent
Li et al.

(10) Patent No.: US 11,981,000 B2
(45) Date of Patent: May 14, 2024

(54) COATED ABRASIVE ARTICLES AND METHODS OF MAKING COATED ABRASIVE ARTICLES

(71) Applicant: 3M INNOVATIVE PROPERTIES COMPANY, St. Paul, MN (US)

(72) Inventors: Junting Li, Woodbury, MN (US); Yuyang Liu, St. Paul, MN (US); Mark A. Lukowski, St. Paul, MN (US); Ernest L Thurber, Somerset, WI (US); Brian G. Koethe, Cottage Grove, MN (US); Ann M. Hawkins, Lake Elmo, MN (US); Geoffrey I. Wilson, Woodbury, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 200 days.

(21) Appl. No.: 17/311,139

(22) PCT Filed: Dec. 6, 2019

(86) PCT No.: PCT/IB2019/060534

§ 371 (c)(1),
(2) Date: Jun. 4, 2021

(87) PCT Pub. No.: WO2020/128708

PCT Pub. Date: Jun. 25, 2020

(65) Prior Publication Data

US 2022/0016747 A1 Jan. 20, 2022

Related U.S. Application Data

(60) Provisional application No. 62/781,064, filed on Dec. 18, 2018.

(51) Int. Cl.
*B24D 18/00* (2006.01)
*B24D 3/34* (2006.01)

(52) U.S. Cl.
CPC ..... *B24D 18/0072* (2013.01); *B24D 3/342* (2013.01); *B24D 3/346* (2013.01)

(58) Field of Classification Search
CPC ..... B24D 18/0072; B24D 3/342; B24D 3/346
See application file for complete search history.

(56) References Cited

U.S. PATENT DOCUMENTS 1,910,444 A 5/1933 Nicholson
2,194,472 A 3/1940 Jackson
(Continued)

FOREIGN PATENT DOCUMENTS

EP 0615816 9/1994
EP 0706440 4/1996
(Continued)

OTHER PUBLICATIONS

International Search Report for PCT International Application No. PCT/IB2019/060534, dated Feb. 24, 2020, 5 pages.

*Primary Examiner* — Pegah Parvini
(74) *Attorney, Agent, or Firm* — Kathleen B. Gross; Bradford B. Wright

(57) ABSTRACT

A coated abrasive article comprises a backing having first and second opposed major surfaces. A make layer is bonded to the first major surface. Agglomerate grinding aid particles are directly bonded to the make layer. At least a portion of the agglomerate grinding aid particles comprise grinding aid particles retained in a binder, and are arranged according to an open predetermined pattern. Abrasive particles are directly bonded to the make layer in spaces between the agglomerate grinding aid particles. A size layer is directly bonded to the make layer, agglomerate grinding aid particles, and abrasive particles. A method of making a coated abrasive article, in which the agglomerate grinding aid particles are deposited onto a curable make layer precursor prior to depositing abrasive particles onto the curable make
(Continued)

layer precursor in spaces between the agglomerate grinding aid particles is also disclosed.

17 Claims, 2 Drawing Sheets

(56) References Cited

U.S. PATENT DOCUMENTS

| | | | |
|---|---|---|---|
| 3,041,156 | A | 6/1962 | Rowse |
| 3,058,819 | A | 10/1962 | Paulson |
| 3,616,580 | A | 11/1971 | Dewell |
| 3,676,092 | A | 7/1972 | Buell |
| 3,784,365 | A | 1/1974 | Caserta |
| 3,833,346 | A | 9/1974 | Wirth |
| 3,868,232 | A | 2/1975 | Sioui |
| 3,869,834 | A | 3/1975 | Mullin |
| 4,311,489 | A | 1/1982 | Kressner |
| 4,314,827 | A | 2/1982 | Leitheiser |
| 4,393,021 | A | 7/1983 | Eisenberg |
| 4,475,926 | A | 10/1984 | Hickory |
| 4,518,397 | A | 5/1985 | Leitheiser |
| 4,623,364 | A | 11/1986 | Cottringer |
| 4,652,275 | A | 3/1987 | Bloecher |
| 4,734,104 | A | 3/1988 | Broberg |
| 4,737,163 | A | 4/1988 | Larkey |
| 4,744,802 | A | 5/1988 | Schwabel |
| 4,751,138 | A | 6/1988 | Tumey |
| 4,770,671 | A | 9/1988 | Monroe |
| 4,799,939 | A | 1/1989 | Bloecher |
| 4,881,951 | A | 11/1989 | Wood |
| 4,927,431 | A | 5/1990 | Buchanan |
| 4,997,461 | A | 3/1991 | Markhoff-Matheny |
| 5,011,508 | A | 4/1991 | Wald |
| 5,042,991 | A | 8/1991 | Kunz |
| 5,078,753 | A | 1/1992 | Broberg |
| 5,085,671 | A | 2/1992 | Martin |
| 5,090,968 | A | 2/1992 | Pellow |
| 5,108,463 | A | 4/1992 | Buchanan |
| 5,137,542 | A | 8/1992 | Buchanan |
| 5,139,978 | A | 8/1992 | Wood |
| 5,152,917 | A | 10/1992 | Pieper |
| 5,201,916 | A | 4/1993 | Berg |
| 5,203,884 | A | 4/1993 | Buchanan |
| 5,213,591 | A | 5/1993 | Celikkaya |
| 5,227,104 | A | 7/1993 | Bauer |
| 5,269,821 | A | 12/1993 | Helmin |
| 5,328,716 | A | 7/1994 | Buchanan |
| 5,352,254 | A | 10/1994 | Celikkaya |
| 5,366,523 | A | 11/1994 | Rowenhorst |
| 5,378,251 | A | 1/1995 | Culler |
| 5,417,726 | A | 5/1995 | Stout |
| 5,435,816 | A | 7/1995 | Spurgeon |
| 5,436,063 | A | 7/1995 | Follett |
| 5,454,750 | A | 10/1995 | Cosmano |
| 5,496,386 | A | 3/1996 | Broberg |
| 5,498,268 | A | 3/1996 | Gagliardi |
| 5,498,269 | A | 3/1996 | Larmie |
| 5,500,273 | A | 3/1996 | Holmes |
| 5,520,711 | A | 5/1996 | Helmin |
| 5,551,962 | A | 9/1996 | Ho |
| 5,552,225 | A | 9/1996 | Ho |
| 5,578,098 | A | 11/1996 | Gagliardi |
| 5,584,896 | A | 12/1996 | Broberg |
| 5,609,706 | A | 3/1997 | Benedict |
| RE35,570 | E | 7/1997 | Rowenhorst |
| 5,672,097 | A | 9/1997 | Hoopman |
| 5,766,277 | A | 6/1998 | DeVoe |
| 5,946,991 | A | 9/1999 | Hoopman |
| 5,954,844 | A | 9/1999 | Law |
| 5,961,674 | A | 10/1999 | Gagliardi |
| 5,975,987 | A | 11/1999 | Hoopman |
| 5,975,988 | A | 11/1999 | Christianson |
| 5,984,988 | A | 11/1999 | Berg |
| 6,077,601 | A | 6/2000 | DeVoe |
| 6,129,540 | A | 10/2000 | Hoopman |
| 6,228,133 | B1 | 5/2001 | Thurber |
| 6,582,487 | B2 | 6/2003 | Larson |
| 6,843,815 | B1 | 1/2005 | Thurber |
| 8,034,137 | B2 | 10/2011 | Erickson |
| 8,142,531 | B2 | 3/2012 | Adefris |
| 8,142,532 | B2 | 3/2012 | Erickson |
| 8,142,891 | B2 | 3/2012 | Culler |
| 8,974,560 | B2 | 3/2015 | Wang |
| 2009/0165394 | A1 | 7/2009 | Culler |
| 2009/0169816 | A1 | 7/2009 | Erickson |
| 2012/0227333 | A1 | 9/2012 | Adefris |
| 2013/0040537 | A1 | 2/2013 | Schwabel |
| 2013/0125477 | A1 | 5/2013 | Adefris |
| 2016/0205133 | A1 | 7/2016 | Mackey |
| 2016/0205267 | A1 | 7/2016 | Vaughn |
| 2016/0311081 | A1 | 10/2016 | Culler |
| 2017/0007703 | A1 | 1/2017 | Matsushita |
| 2017/0007714 | A1 | 1/2017 | Kontermann |
| 2019/0202031 | A1 | 7/2019 | Wang |

FOREIGN PATENT DOCUMENTS

| | | |
|---|---|---|
| WO | WO 95-01241 | 1/1995 |
| WO | WO 95-20469 | 8/1995 |
| WO | WO 2016-205133 | 12/2016 |
| WO | WO 2018-119275 | 6/2018 |

COATED ABRASIVE ARTICLES AND METHODS OF MAKING COATED ABRASIVE ARTICLES

TECHNICAL FIELD

The present disclosure broadly relates to agglomerate particles containing grinding aid and abrasive articles containing them.

BACKGROUND

Coated abrasive articles are broadly useful for abrading, finishing, or grinding a wide variety of materials and surfaces in the manufacturing of goods. Generally, coated abrasive articles comprise a backing, a first layer of cured resinous adhesive layer (make layer) applied over one major surface of the backing, abrasive particles, a second cured resinous adhesive layer (size layer), and optionally a third cured resinous adhesive layer (supersize layer). In some situations, grinding aids are used to improve abrasion performance and are typically used as an additive in the formulation of at least one of the foregoing resinous adhesive layer.

SUMMARY

Typically, only a small fraction of abrasive particles that are present in coated abrasive articles is actually utilized during the life of the articles. For example, many of the abrasive particles may not contact the workpiece before the coated abrasive articles are worn out. It is desirable to have abrasive particles arranged in a coated abrasive article in such a way as to increase the efficiency of abrasive particles usage and prolong the life of the articles.

Accordingly, in one aspect, the present disclosure provides a coated abrasive article comprising:

a backing having first and second opposed major surfaces; a make layer bonded to the first major surface; agglomerate grinding aid particles directly bonded to the make layer, wherein the agglomerate grinding aid particles comprise grinding aid particles retained in a binder, and wherein at least a portion of the agglomerate grinding aid particles are arranged according to an open predetermined pattern; abrasive particles directly bonded to the make layer, wherein the abrasive particles are disposed in spaces between the agglomerate grinding aid particles; a size layer directly bonded to the make layer, agglomerate grinding aid particles, and abrasive particles.

Advantageously, coated abrasive articles according to the present disclosure may exhibit superior abrading performance as compared to previous similar coated abrasive articles.

In a second aspect, the present disclosure provides a method of making a coated abrasive article, the method comprising sequentially: depositing a curable make layer precursor on a major surface of a backing; depositing agglomerate grinding aid particles onto the curable make layer precursor, wherein the agglomerate grinding aid particles comprise grinding aid particles retained in a binder; depositing abrasive particles onto the curable make layer precursor, wherein the abrasive particles are disposed in spaces between the agglomerate grinding aid particles; at least partially curing the curable make layer precursor to provide an at least partially cured make layer precursor; depositing a curable size layer precursor onto at least a portion of the agglomerate grinding aid particles, abrasive particles, and at least partially cured make layer precursor; and at least partially curing the curable size layer precursor.

As used herein, the term "agglomerate" refers to a mass formed by binding particles together by means of a binder or binders.

As used herein, by definition, abrasive particles consist of material having a Mohs hardness of at least 6.5, and grinding aid particles consist of material having a Mohs hardness of less than 6.5. Hence, no particle can be simultaneously an abrasive particle and a grinding aid particle.

The terms "cured", "curing" and "curable" refer to joining polymer chains together by covalent chemical bonds, usually via crosslinking molecules or groups, to form a network. Therefore, in this disclosure the terms "cured" and "crosslinked" may be used interchangeably.

Features and advantages of the present disclosure will be further understood upon consideration of the detailed description as well as the appended claims.

Figure 1A:
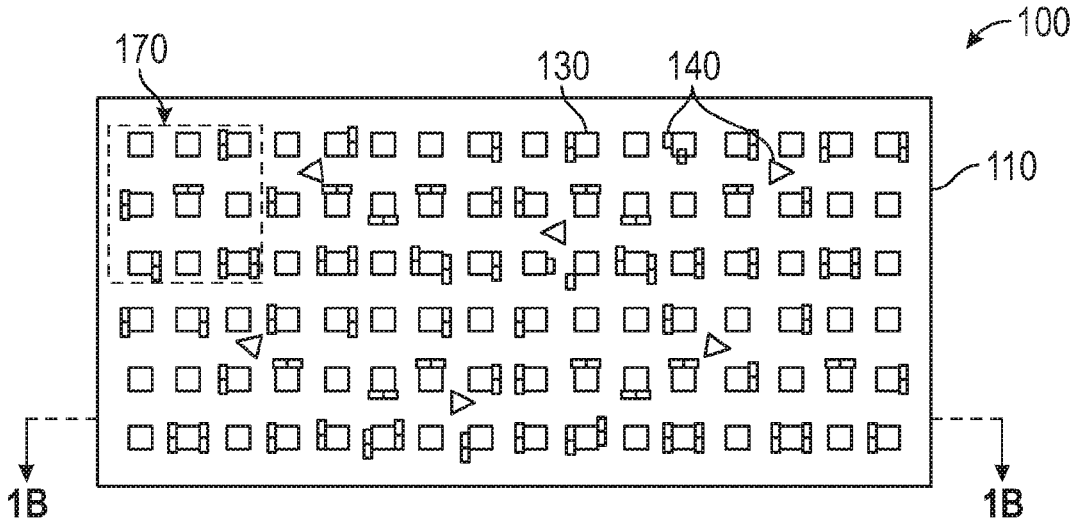
FIG. 1A is a schematic top view of an exemplary coated abrasive article 100 according to the present disclosure.

Repeated use of reference characters in the specification and drawings is intended to represent the same or analogous features or elements of the disclosure. It should be understood that numerous other modifications and embodiments can be devised by those skilled in the art, which fall within the scope and spirit of the principles of the disclosure. The figures may not be drawn to scale.

DETAILED DESCRIPTION

Figure 1B:
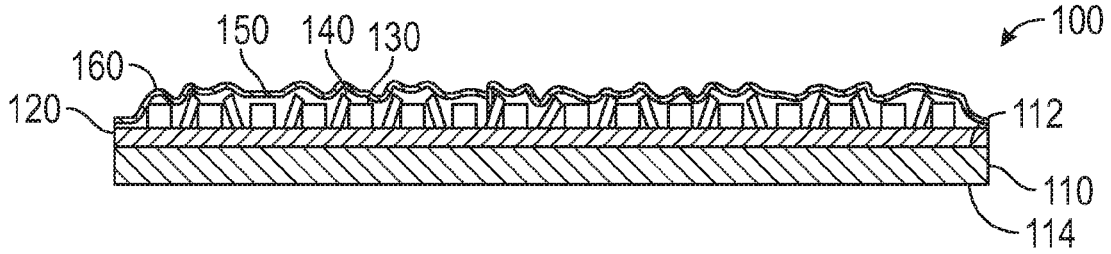
FIG. 1B is a schematic cross-sectional view taken along line 1B-1B in FIG. 1A.

Referring now to FIG. 1B, coated abrasive article 100 comprises backing 110 having first major surface 112 and second major surface 114 opposite first major surface 112. Make layer 120 is disposed on and bonded to first major surface 112. Agglomerate grinding aid particles 130 and abrasive particles 140 are bonded to make layer 120. Size layer 150 is disposed over and bonded to make layer 120, agglomerate grinding aid particles 130, and abrasive particles 140. Optional supersize layer 160 is disposed over and bonded to size layer 150.

Referring now to FIG. 1A, agglomerate grinding aid particles 130 are arranged according to predetermined pattern 170, with abrasive particles 140 residing in the spaces between the agglomerate grinding aid particles 130.

Exemplary suitable materials for the backing include polymeric films, metal foils, woven fabrics, knitted fabrics, paper, vulcanized fiber, nonwovens, foams, screens, laminates, combinations thereof, and treated versions thereof. The coated abrasive article may be in the form of a sheet, disc, belt, pad, or roll. The backing may be rigid, semi-rigid, or flexible. In some embodiments, the backing should be sufficiently flexible to allow the coated abrasive article to be formed into a loop to make an abrasive belt that can be run on suitable grinding equipment. For applications where stiffness of the backing is desired, a flexible backing may also be used by affixing it to a rigid backup pad mounted to the grinding tool. For off-hand grinding applications where stiffness and cost are concerns, vulcanized fiber backings are typically preferred. In some embodiments, the backing may be circular and may comprise a continuous uninterrupted disc, while in others it may have a central arbor hole for mounting. Likewise, the circular backing may be flat or it may have a depressed central hub, for example, a Type 27 depressed center disc. In some embodiments, the backing has a mechanical fastener, or adhesive fastener securely attached to a major surface opposite the abrasive layer.

The make layer, size layer and the optional supersize layer comprise a resinous binder which may be the same or different. Exemplary suitable binders can be prepared from corresponding binder precursors such as thermally curable resins, radiation-curable resins, and combinations thereof.

Binder precursors (e.g., make layer precursors and/or size layer precursors) may comprise, for example, glue, phenolic resin, aminoplast resin, urea-formaldehyde resin, melamine-formaldehyde resin, urethane resin, free-radically polymerizable polyfunctional (meth)acrylate (e.g., aminoplast resin having pendant α,β-unsaturated groups, acrylated urethane, acrylated epoxy, acrylated isocyanurate), epoxy resin (including bis-maleimide and fluorene-modified epoxy resins), isocyanurate resin, and mixtures thereof. Of these, phenolic resins are preferred, especially when used in combination with a vulcanized fiber backing.

Phenolic resins are generally formed by condensation of phenol and formaldehyde, and are usually categorized as resole or novolac phenolic resins. Novolac phenolic resins are acid-catalyzed and have a molar ratio of formaldehyde to phenol of less than 1:1. Resole (also resol) phenolic resins can be catalyzed by alkaline catalysts, and the molar ratio of formaldehyde to phenol is greater than or equal to one, typically between 1.0 and 3.0, thus presenting pendant methylol groups. Alkaline catalysts suitable for catalyzing the reaction between aldehyde and phenolic components of resole phenolic resins include sodium hydroxide, barium hydroxide, potassium hydroxide, calcium hydroxide, organic amines, and sodium carbonate, all as solutions of the catalyst dissolved in water.

Resole phenolic resins are typically coated as a solution with water and/or organic solvent (e.g., alcohol). Typically, the solution includes about 70 percent to about 85 percent solids by weight, although other concentrations may be used. If the solids content is very low, then more energy is required to remove the water and/or solvent. If the solids content is very high, then the viscosity of the resulting phenolic resin is too high which typically leads to processing problems.

Phenolic resins are well-known and readily available from commercial sources. Examples of commercially available resole phenolic resins useful in practice of the present disclosure include those marketed by Durez Corporation under the trade designation VARCUM (e.g., 29217, 29306, 29318, 29338, 29353); those marketed by Ashland Chemical Co. of Bartow, Florida under the trade designation AEROFENE (e.g., AEROFENE 295); and those marketed by Kangnam Chemical Company Ltd. of Seoul, South Korea under the trade designation PHENOLITE (e.g., PHENOLITE TD-2207).

Binder precursors can further comprise optional additives such as, for example, fillers (including grinding aids), fibers, lubricants, wetting agents, surfactants, pigments, dyes, coupling agents, resin curatives, plasticizers, antistatic agents, and suspending agents. Examples of fillers suitable for this invention include wood pulp, vermiculite, and combinations thereof, metal carbonates, such as calcium carbonate, e.g., chalk, calcite, marl, travertine, marble, and limestone, calcium magnesium carbonate, sodium carbonate, magnesium carbonate; silica, such as amorphous silica, quartz, glass beads, glass bubbles, and glass fibers; silicates, such as talc, clays (montmorillonite), feldspar, mica, calcium silicate, calcium metasilicate, sodium aluminosilicate, sodium silicate; metal sulfates, such as calcium sulfate, barium sulfate, sodium sulfate, aluminum sodium sulfate, aluminum sulfate; gypsum; vermiculite; wood flour; aluminum trihydrate; metal oxides, such as calcium oxide (lime), aluminum oxide, titanium dioxide, and metal sulfites, such as calcium sulfite.

Binder precursors may be applied by any known coating method, including, for example, including roll coating, extrusion die coating, curtain coating, knife coating, gravure coating, and spray coating.

The basis weight of the make layer utilized may depend, for example, on the intended use(s), type(s) and grade(s) of abrasive particles, and nature of the coated abrasive disk being prepared, but typically will be in the range of from 1, 2, 5, 10, or 15 grams per square meter (gsm) to 20, 25, 100, 200, 300, 400, or even 600 gsm.

The agglomerate grinding aid particles comprise grinding aid particles retained in a binder. The binder may be, for example, inorganic (e.g., vitreous binder or a dried inorganic sol) or, more typically, organic. In the case of crosslinked binders, the binders typically result from curing a corresponding binder precursor. Exemplary organic binders include pressure-sensitive adhesive binders, glues, and hot-melt adhesive binders. Exemplary pressure-sensitive adhesives include latex crepe, rosin, certain acrylic polymers and copolymers including polyacrylate esters (e.g., poly(butyl acrylate)) polyvinyl ethers (e.g., poly(vinyl n-butyl ether)), poly(alpha-olefins), silicones, alkyd adhesives, rubber adhesives (e.g., natural rubber, synthetic rubber, chlorinated rubber), and mixtures thereof. Exemplary thermosetting binder precursors include phenolic resins (e.g., resole resins and novolac resins), aminoplast resins, urea-formaldehyde resins, melamine-formaldehyde resins, one- and two-part polyurethanes, acrylic resins (e.g., acrylic monomers and oligomers, acrylated polyethers, aminoplast resins having pendant α,β-unsaturated groups, acrylated polyurethanes), epoxy resins (including bis-maleimide and fluorene-modified epoxy resins), isocyanurate resin, moisture-curable silicones, as well as mixtures thereof.

A grinding aid is defined as particulate material, the addition of which to an abrasive article has a significant effect on the chemical and physical processes of abrading. In particular, it is believed that the grinding aid may: (1) decrease the friction between the abrasive particles and the workpiece being abraded; (2) prevent the abrasive particles from "capping", i.e., prevent metal particles from becoming welded to the tops of the abrasive particles; (3) decrease the interface temperature between the abrasive particles and the workpiece; (4) decrease the grinding forces; and/or (5) have a synergistic effect of the mechanisms mentioned above. In general, the addition of a grinding aid increases the useful life of the coated abrasive article. Grinding aids encompass a wide variety of different materials and can be inorganic or organic.

Exemplary grinding aids may include inorganic halide salts, halogenated compounds and polymers, and organic and inorganic sulfur-containing materials. Exemplary grinding aids, which may be organic or inorganic, include waxes, halogenated organic compounds such as chlorinated waxes like tetrachloronaphthalene, pentachloronaphthalene, and polyvinyl chloride; halide salts such as sodium chloride, potassium cryolite, sodium cryolite, ammonium cryolite, potassium tetrafluoroborate, sodium tetrafluoroborate, silicon fluorides, potassium chloride, magnesium chloride; and metals and their alloys such as tin, lead, bismuth, cobalt, antimony, cadmium, iron, and titanium. Examples of other grinding aids include sulfur, organic sulfur compounds, graphite, and metallic sulfides, organic and inorganic phosphate-containing materials. A combination of different grinding aids may be used.

Preferred grinding aids include halide salts, particularly potassium tetrafluoroborate ($KBF_4$), cryolite ($Na_3AlF_6$), and ammonium cryolite [$(NH_4)_3AlF_6$]. Other halide salts that can be used as grinding aids include sodium chloride, potassium cryolite, sodium tetrafluoroborate, silicon fluorides, potassium chloride, and magnesium chloride. Other preferred grinding aids are those in U.S. Pat. No. 5,269,821 (Helmin et al.), which describes grinding aid agglomerates comprised of water soluble and water insoluble grinding aid particles. Other useful grinding aid agglomerates are those wherein a plurality of grinding aid particles are bound together into an agglomerate with a binder. Agglomerates of this type are described in U.S. Pat. No. 5,498,268 (Gagliardi et al.).

Examples of halogenated polymers useful as grinding aids include polyvinyl halides (e.g., polyvinyl chloride) and polyvinylidene halides such as those disclosed in U.S. Pat. No. 3,616,580 (Dewell et al.); highly chlorinated paraffin waxes such as those disclosed in U.S. Pat. No. 3,676,092 (Buell); completely chlorinated hydrocarbons resins such as those disclosed in U.S. Pat. No. 3,784,365 (Caserta et al.); and fluorocarbons such as polytetrafluoroethylene and polytrifluorochloroethylene as disclosed in U.S. Pat. No. 3,869,834 (Mullin et al.).

Inorganic sulfur-containing materials useful as grinding aids include elemental sulfur, iron (II) sulfide, cupric sulfide, molybdenum sulfide, potassium sulfate, and the like, as variously disclosed in U.S. Pat. No. 3,833,346 (Wirth), U.S. Pat. No. 3,868,232 (Sioui et al.), and U.S. Pat. No. 4,475,926 (Hickory). Organic sulfur-containing materials (e.g., thiourea) for use in the invention include those mentioned in U.S. Pat. No. 3,058,819 (Paulson).

It is also within the scope of this disclosure to use a combination of different grinding aids and, in some instances, this may produce a synergistic effect. The above-mentioned examples of grinding aids are meant to be a representative showing of grinding aids, and they are not meant to encompass all grinding aids.

In some embodiments, the agglomerate grinding aid particles are free of abrasive particles; however, this is not a requirement.

Grinding aid particles included in the agglomerate grinding aid particles may have an average particle size ranging from about 1 micrometer to about 100 micrometers, and more preferably ranging from about 5 micrometers to about 50 micrometers, although other sizes may be used.

Agglomerate grinding aid particles may also comprise other components and/or additives, such as abrasive particles, fillers, diluents, fibers, lubricants, wetting agents, surfactants, pigments, dyes, coupling agents, resin curatives, plasticizers, antistatic agents, and suspending agents. Examples of fillers suitable for this invention include wood pulp, vermiculite, and combinations thereof, metal carbonates, such as calcium carbonate, e.g., chalk, calcite, marl, travertine, marble, and limestone, calcium magnesium carbonate, sodium carbonate, magnesium carbonate; silica, such as amorphous silica, quartz, glass beads, glass bubbles, and glass fibers; silicates, such as talc, clays (montmorillonite), feldspar, mica, calcium silicate, calcium metasilicate, sodium aluminosilicate, sodium silicate; metal sulfates, such as calcium sulfate, barium sulfate, sodium sulfate, aluminum sodium sulfate, aluminum sulfate; gypsum; vermiculite; wood flour; aluminum trihydrate; metal oxides, such as calcium oxide (lime), aluminum oxide, titanium dioxide, and metal sulfites, such as calcium sulfite.

Agglomerate grinding aid particles can be disposed onto the make layer by various coating methods that are known in the art, including drop coating, electrostatic coating, individual placement (e.g., using a pick and place robot), and transfer coating.

In some embodiments, the agglomerate grinding aid particles are graded according to a nominal screened grade using U.S.A. Standard Test Sieves conforming to ASTM E-11 "Standard Specification for Wire Cloth and Sieves for Testing Purposes". ASTM E-11 proscribes the requirements for the design and construction of testing sieves using a medium of woven wire cloth mounted in a frame for the classification of materials according to a designated particle size. A typical designation may be represented as −18+20 meaning that the agglomerate grinding aid particles pass through a test sieve meeting ASTM E-11 specifications for the number 18 sieve and are retained on a test sieve meeting ASTM E-11 specifications for the number 20 sieve. In one embodiment, the formed ceramic abrasive particles have a particle size such that most of the agglomerate grinding aid particles pass through an 18 mesh test sieve and are retained on a 20, 25, 30, 35, 40, 45, or 50 mesh test sieve. In various embodiments of the invention, the formed ceramic abrasive particles can have a nominal screened grade comprising: −18+20, −20+25, −25+30, −30+35, −35+40, −40+45, −45+50, −50+60, −60+70, −70+80, −80+100, −100+120, −120+140, −140+170, −170+200, −200+230, −230+270, −270+325, −325+400, −400+45 0, −450+500, or −500+635.

Preferably, at least a portion of agglomerate grinding aid particles are disposed on the make layer in a predetermined pattern. Agglomerate grinding aid particles can be disposed onto the make layer by various patterned coating methods that are known in the art, including patterned drop coating, individual placement (e.g., using a pick and place robot), and transfer coating using a tool having patterned cavities therein. In some embodiments, patterned drop coating can be achieved using an alignment tool by methods analogous to that described in PCT Pat. Appl. Publ. Nos. 2016/205133 (Wilson et al.), 2016/205267 (Wilson et al.), 2017/007703 (Wilson et al.), 2017/007714 (Liu et al.), except using agglomerate grinding aid particles in place of abrasive particles. Transfer coating using a tool having patterned cavities can be analogous to that described in U.S. Pat. Appln. Publ. No. 2016/0311081 A1 (Culler et al.), except using agglomerate grinding aid particles in place of abrasive particles. In some embodiments, agglomerate grinding aid particles can be applied onto the make layer through a patterned mesh or sieve.

A coated abrasive article may include agglomerate grinding aid particles arranged randomly, in a single predetermined pattern, or in multiple different patterns. At least a portion of the agglomerate grinding aid particles may be positioned such that a pattern formed by these agglomerate grinding aid particles includes a plurality of parallel lines and/or a grid pattern. As a further example, at least a portion of agglomerate grinding aid particles can be positioned such that a pattern formed by these agglomerate grinding aid particles includes a plurality of circles (hollow or filled).

Likewise, at least a portion of agglomerate grinding aid particles may be arranged in a spiral, checkerboard, or striped (in any orientation).

Agglomerate grinding aid particles are disposed on a curable make layer precursor, followed by deposition of abrasive particles, and then at least partially curing of the make layer precursor to bond them. Due to the presence of the agglomerate grinding aid particles, at least a portion of the abrasive particles (and especially abrasive platelets) are deposited such that they contact at least one agglomerate grinding aid particle. As a result, at least some of the abrasive particles are disposed at an incline against respective agglomerate grinding aid particles in an outwardly raised orientation, and the amount so incline will generally be greater than would be achieved by depositing the abrasive particles and agglomerate grinding aid particles simultaneously or in the converse sequence.

Figure 2:
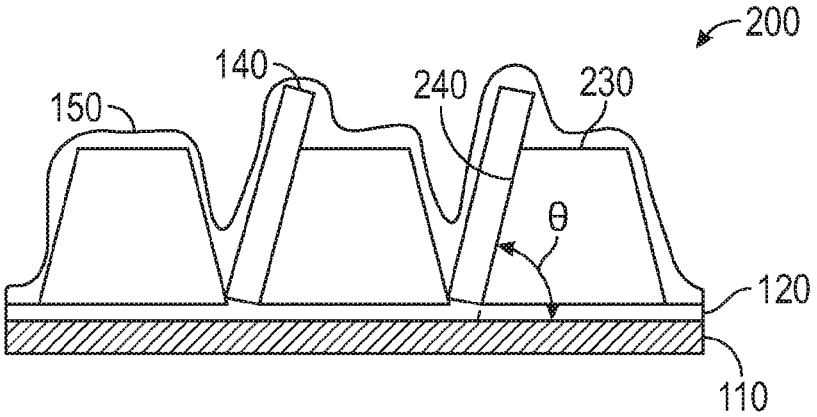
FIG. 2 is a schematic side view of an exemplary coated abrasive article 200 that shows the effect of shaped agglomerate grinding aid particles on abrasive particle orientation.

Referring now to FIG. 2, exemplary coated abrasive article 200 has backing 110, make layer 120, size layer 150, shaped abrasive particles 140, and shaped agglomerate grinding aid particles 230. At least a portion of abrasive particles 140 are positioned in a raised orientation at an incline due to the presence of the shaped agglomerate grinding aid particles 230. Shaped agglomerate grinding aid particles 230 are individually positioned such that an acute angle $\Theta$ is formed between at least one sidewall 240 of respective shaped agglomerate grinding aid particles 230 and backing 120. In this context, a sidewall is a planar surface that contacts the make layer and extends outwardly from the backing. This raised orientation results in better abrading performance (e.g., cut rate). Generally, the greater the number of abrasive particles that are raised, the better the abrading performance. To function optimally, the abrasive particles preferably extend further away from the backing (are taller) than the agglomerate grinding aid particles; however, since the agglomerate grinding aid particles are easily eroded the abrasive particle may be shorter with similar result.

In order to increase the chance of abrasive particles contacting and being oriented upwardly, it is desirable to cover a large percentage of the surface of the make layer precursor (and hence also the resultant make layer) with agglomerate grinding aid particles. The percentage of the surface of the make layer precursor (and/or resultant make layer) covered by agglomerate grinding aid particles may be any amount, but is preferably at least 5 percent, at least 10 percent, at least 15 percent, or even at least 20 percent, based on projected surface viewed normal to the backing. However, the extent of surface coverage should not be so high that there is insufficient space for enough abrasive particles to become adhered that a practical coated abrasive article is obtained. Accordingly, the percentage of the surface of the make layer precursor (and/or resultant make layer) covered by agglomerate grinding aid particles may be less than 40 percent, less than 30 percent, or even less than 20 percent, based on projected surface viewed normal to the backing, for example. In some preferred embodiments, the agglomerate grinding aid particles are arranged according to an open predetermined pattern. In some preferred embodiments, the agglomerate grinding aid particles and abrasive particles are collectively present in sufficient quantity to form a closed coat.

Other than depositing the agglomerate grinding aid particles on the make layer precursor prior to depositing the abrasive particles during manufacture of the coated abrasive article, the process of making coated abrasive articles is substantially the same as known in the art. Details concerning manufacture of coated abrasive articles can be found in, for example comprising an abrasive layer secured to a backing, wherein the abrasive layer comprises abrasive particles and make, size, and optional supersize layers are well known, and may be found in, for example, U.S. Pat. No. 4,734,104 (Broberg); U.S. Pat. No. 4,737,163 (Larkey); U.S. Pat. No. 5,203,884 (Buchanan et al.); U.S. Pat. No. 5,152,917 (Pieper et al.); U.S. Pat. No. 5,378,251 (Culler et al.); U.S. Pat. No. 5,417,726 (Stout et al.); U.S. Pat. No. 5,436,063 (Follett et al.); U.S. Pat. No. 5,496,386 (Broberg et al.); U.S. Pat. No. 5,609,706 (Benedict et al.); U.S. Pat. No. 5,520,711 (Helmin); U.S. U.S. Pat. No. 5,954,844 (Law et al.); U.S. Pat. No. 5,961,674 (Gagliardi et al.); U.S. Pat. No. 4,751,138 (Bange et al.); U.S. Pat. No. 5,766,277 (DeVoe et al.); U.S. Pat. No. 6,077,601 (DeVoe et al.); U.S. Pat. No. 6,228,133 (Thurber et al.); and U.S. Pat. No. 5,975,988 (Christianson).

The shapes of the agglomerate grinding aid particles may be random or geometrically shaped. To improve the chance of beneficial orientation of the abrasive particles, the agglomerate grinding aid particles are preferably shaped, more preferably precisely-shaped, with an aspect ratio of 3 or less, preferably less than 2, and more preferably less than 1.5, although this is not a requirement. In some preferred embodiments, agglomerate grinding aid particles are precisely shaped and have a predetermined shape that is replicated from a mold cavity used to form an agglomerate grinding aid particle. In some of these embodiments, the shaped agglomerate grinding aid particles have three-dimensional shapes such as pyramids (e.g., 3-, 4-, 5-, or 6-sided pyramids), cones, blocks, cubes, spheres, cylinders, rods, prisms (e.g., 3-, 4-, 5-, or 6-sided prisms), and truncated versions of these and the like. Preferably, at least one of the shaped agglomerate grinding aid particles according to the present disclosure is frustopyramidal, which may also be referred to as a truncated pyramid. In some embodiments, at least one of the agglomerate grinding aid particle or the agglomerate particle has a triangular frustopyramidal shape, a square frustopyramidal shape, or a hexagonal frustopyramidal shape. In some other embodiments, examples of useful shapes of the shaped agglomerate grinding aid particles include triangular, rectangular, square, pentagonal, and hexagonal prisms.

Figure 3:
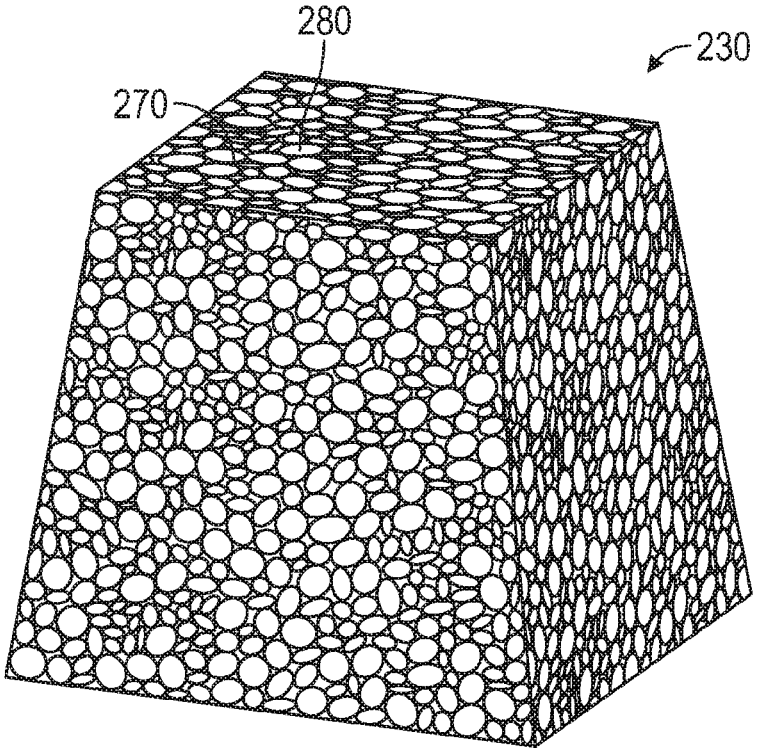
FIG. 3 is a schematic perspective view of shaped agglomerate grinding aid particle 230.

FIG. 3 shows an enlarged view of a shaped agglomerate grinding aid particle 230 composed of grinding aid particles 280 bound together by binder 270.

The abrasive particles, whether crushed or shaped, should have sufficient hardness and surface roughness to function as abrasive particles in an abrading process. Preferably, the abrasive particles have a Mohs hardness of at least 4, at least 5, at least 6, at least 7, or even at least 8.

Useful abrasive materials include, for example, fused aluminum oxide, heat treated aluminum oxide, white fused aluminum oxide, ceramic aluminum oxide materials such as those commercially available as 3M CERAMIC ABRASIVE GRAIN from 3M Company of St. Paul, Minnesota, black silicon carbide, green silicon carbide, titanium diboride, boron carbide, tungsten carbide, titanium carbide, cubic boron nitride, garnet, fused alumina zirconia, sol-gel derived ceramics (e.g., alumina ceramics doped with chromia, ceria, zirconia, titania, silica, and/or tin oxide), silica (e.g., quartz, glass beads, glass bubbles and glass fibers), feldspar, or flint. Examples of sol-gel derived crushed ceramic particles can be found in U.S. Pat. No. 4,314,827 (Leitheiser et al.), U.S. Pat. No. 4,623,364 (Cottringer et al.); U.S. Pat. No. 4,744,802 (Schwabel), U.S. Pat. No. 4,770,671 (Monroe et al.); and U.S. Pat. No. 4,881,951 (Monroe et al.).

As discussed previously, the abrasive particles may be shaped (e.g., precisely-shaped) or random (e.g., crushed). Shaped abrasive particles and precisely-shaped abrasive particles can be prepared, for example, by a molding process using sol-gel technology as described in U.S. Pat. No. 5,201,916 (Berg); U.S. Pat. No. 5,366,523 (Rowenhorst (Re 35,570)); and U.S. Pat. No. 5,984,988 (Berg). U.S. Pat. No. 8,034,137 (Erickson et al.) describes alumina particles that have been formed in a specific shape, then crushed to form shards that retain a portion of their original shape features. Exemplary shapes of abrasive particles include crushed, pyramids (e.g., 3-, 4-, 5-, or 6-sided pyramids), truncated pyramids (e.g., 3-, 4-, 5-, or 6-sided truncated pyramids), cones, truncated cones, rods (e.g., cylindrical, vermiform), and prisms (e.g., 3-, 4-, 5-, or 6-sided prisms).

The abrasive particles may be independently sized according to an abrasives industry recognized specified nominal grade. Exemplary abrasive industry recognized grading standards include those promulgated by ANSI (American National Standards Institute), FEPA (Federation of European Producers of Abrasives), and JIS (Japanese Industrial Standard). ANSI grade designations (i.e., specified nominal grades) include, for example: ANSI 4, ANSI 6, ANSI 8, ANSI 16, ANSI 24, ANSI 36, ANSI 46, ANSI 54, ANSI 60, ANSI 70, ANSI 80, ANSI 90, ANSI 100, ANSI 120, ANSI 150, ANSI 180, ANSI 220, ANSI 240, ANSI 280, ANSI 320, ANSI 360, ANSI 400, and ANSI 600. FEPA grade designations include F4, F5, F6, F7, F8, F10, F12, F14, F16, F20, F22, F24, F30, F36, F40, F46, F54, F60, F70, F80, F90, F100, F120, F150, F180, F220, F230, F240, F280, F320, F360, F400, F500, F600, F800, F1000, F1200, F1500, F2000, P12, P16, P20, P24, P30, P36, P40, P50, P60, P80, P100, P120, P150, P180, P220, P240, P280, P320, P360, P400, P500, P600, P800, P1000, P1200, P1500, P2000, and P2500. JIS grade designations include JIS8, JIS12, JIS16, JIS24, JIS36, JIS46, JIS54, JIS60, JIS80, JIS100, JIS150, JIS180, JIS220, JIS240, JIS280, JIS320, JIS360, JIS400, JIS600, JIS800, JIS1000, JIS1500, JIS2500, JIS4000, JIS6000, JIS8000, and JIS10,000

Examples of shaped abrasive particles can be found in U.S. Pat. No. 5,201,916 (Berg); U.S. Pat. No. 5,366,523 (Rowenhorst (Re 35,570)); and U.S. Pat. No. 5,984,988 (Berg). U.S. Pat. No. 8,034,137 (Erickson et al.) describes alumina crushed abrasive particles that have been formed in a specific shape, then crushed to form shards that retain a portion of their original shape features. In some embodiments, shaped alpha alumina particles are precisely-shaped (i.e., the particles have shapes that are at least partially determined by the shapes of cavities in a production tool used to make them. Details concerning such precisely-shaped abrasive particles and methods for their preparation can be found, for example, in U.S. Pat. No. 8,142,531 (Adefris et al.); U.S. Pat. No. 8,142,891 (Culler et al.); and U.S. Pat. No. 8,142,532 (Erickson et al.); and in U.S. Pat. Appl. Publ. Nos. 2012/0227333 (Adefris et al.); 2013/0040537 (Schwabel et al.); and 2013/0125477 (Adefris).

Figure 4:
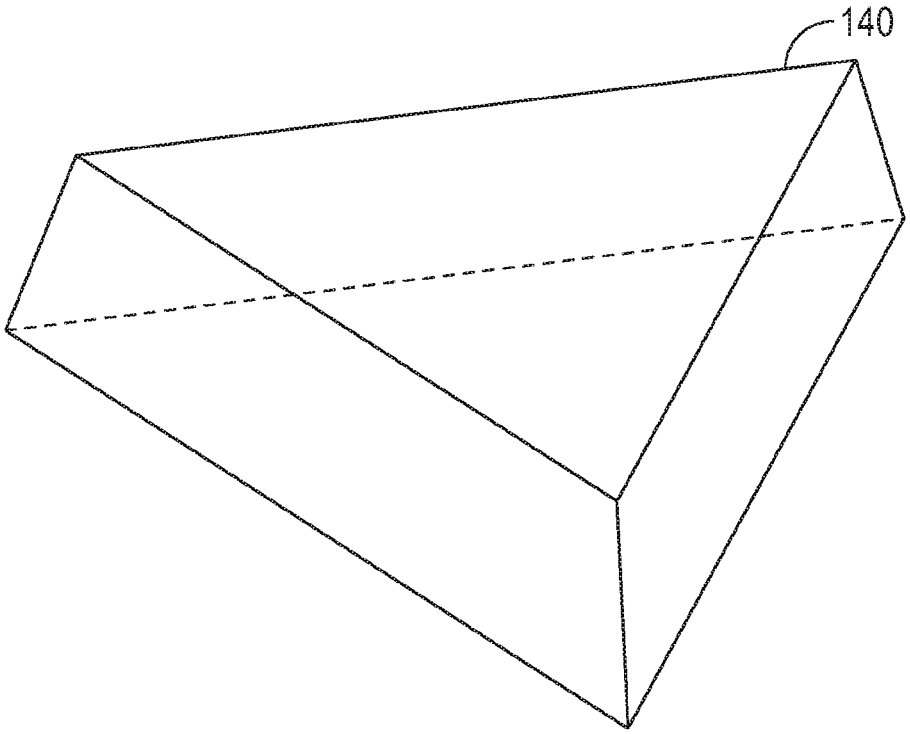
FIG. 4 is a schematic perspective view of exemplary shaped abrasive particle 340.

FIG. 4 shows a representative shaped abrasive particle 140 that can be prepared according to the above methods.

In embodiments wherein the abrasive particles are shaped as triangular platelets (or triangular frustopyramids), they may have a major surface with a vertex of 90 degrees (corresponding to a right triangle), or they may have a major surface with a vertex of greater than 90 degrees (corresponding to an obtuse triangle), although this is not a requirement. Examples include at least 91 degrees, at least 95 degrees, at least 100 degrees, at least 110 degrees, at least 120 degrees, or even at least 130 degrees.

In some preferred embodiments, the abrasive particles comprise platey crushed abrasive particles. Such abrasive particles can be obtained by known methods, from commercial suppliers, and/or by shape sorting such crushed abrasive particles; for example, using a shape-sorting table as is known in the art.

Examples of suitable abrasive particles include crushed abrasive particles comprising fused aluminum oxide, heat-treated aluminum oxide, white fused aluminum oxide, ceramic aluminum oxide materials such as those commercially available as 3M CERAMIC ABRASIVE GRAIN from 3M Company, St. Paul, Minnesota, brown aluminum oxide, blue aluminum oxide, silicon carbide (including green silicon carbide), titanium diboride, boron carbide, tungsten carbide, garnet, titanium carbide, diamond, cubic boron nitride, fused alumina zirconia, iron oxide, chromia, zirconia, titania, quartz, feldspar, flint, emery, sol-gel-derived ceramic (e.g., alpha alumina), and combinations thereof. Further examples include crushed abrasive composites of abrasive particles (which may be platey or not) in a binder matrix, such as those described in U.S. Pat. No. 5,152,917 (Pieper et al.). Many such abrasive particles, agglomerates, and composites are known in the art.

Preferably, crushed abrasive particles comprise ceramic crushed abrasive particles such as, for example, sol-gel-derived polycrystalline alpha alumina particles. Ceramic crushed abrasive particles composed of crystallites of alpha alumina, magnesium alumina spinel, and a rare earth hexagonal aluminate may be prepared using sol-gel precursor alpha alumina particles according to methods described in, for example, U.S. Pat. No. 5,213,591 (Celikkaya et al.) and U.S. Publ. Pat. Appln. Nos. 2009/0165394 A1 (Culler et al.) and 2009/0169816 A1 (Erickson et al.).

Examples of sol-gel-derived abrasive particles from which crushed abrasive particles can be isolated, and methods for their preparation can be found, in U.S. Pat. No. 4,314,827 (Leitheiser et al.); U.S. Pat. No. 4,623,364 (Cottringer et al.); U.S. Pat. No. 4,744,802 (Schwabel), U.S. Pat. No. 4,770,671 (Monroe et al.); and U.S. Pat. No. 4,881,951 (Monroe et al.). It is also contemplated that the crushed abrasive particles could comprise abrasive agglomerates such, for example, as those described in U.S. Pat. No. 4,652,275 (Bloecher et al.) or U.S. Pat. No. 4,799,939 (Bloecher et al.). In some embodiments, the crushed abrasive particles may be surface-treated with a coupling agent (e.g., an organosilane coupling agent) or other physical treatment (e.g., iron oxide or titanium oxide) to enhance adhesion of the crushed abrasive particles to a binder. The crushed abrasive particles may be treated before combining them with the binder, or they may be surface treated in situ by including a coupling agent to the binder.

Further details concerning methods of making sol-gel-derived abrasive particles can be found in, for example, U.S. Pat. No. 4,314,827 (Leitheiser); U.S. Pat. No. 5,152,917 (Pieper et al.); U.S. Pat. No. 5,435,816 (Spurgeon et al.); U.S. Pat. No. 5,672,097 (Hoopman et al.); U.S. Pat. No. 5,946,991 (Hoopman et al.); U.S. Pat. No. 5,975,987 (Hoopman et al.); and U.S. Pat. No. 6,129,540 (Hoopman et al.); and in U.S. Publ. Pat. Appln. No. 2009/0165394 A1 (Culler et al.).

Surface coatings on the various abrasive particles may be used to improve the adhesion between the abrasive particles and a binder in abrasive articles, or can be used to aid in electrostatic deposition. In one embodiment, surface coatings as described in U.S. Pat. No. 5,352,254 (Celikkaya) in an amount of 0.1 to 2 percent surface coating to abrasive particle weight may be used. Such surface coatings are described in U.S. Pat. No. 5,213,591 (Celikkaya et al.); U.S. Pat. No. 5,011,508 (Wald et al.); U.S. Pat. No. 1,910,444 (Nicholson); U.S. Pat. No. 3,041,156 (Rowse et al.); U.S. Pat. No. 5,009,675 (Kunz et al.); U.S. Pat. No. 5,085,671 (Martin et al.); U.S. Pat. No. 4,997,461 (Markhoff-Matheny et al.); and U.S. Pat. No. 5,042,991 (Kunz et al.). Additionally, the surface coating may prevent the shaped abrasive particle from capping. Capping is the term to describe the phenomenon where metal particles from the workpiece being abraded become welded to the tops of the crushed abrasive particles. Surface coatings to perform the above functions are known to those of skill in the art.

Crushed abrasive particles used in practice of the present disclosure are preferably selected to have a length and/or width in a range of from 0.1 micron to 3500 microns, more typically 100 microns to 3000 microns, and more typically 100 microns to 2600 microns, although other lengths and widths may also be used.

Crushed abrasive particles may be selected to have a thickness in a range of from 0.1 micron to 1600 microns, more typically from 1 micron to 1200 microns, although other thicknesses may be used. In some embodiments, platey crushed abrasive particles may have an aspect ratio (length to thickness) of at least 2, 3, 4, 5, 6, or more.

Length, width, and thickness of the abrasive particles can be determined on an individual or average basis, as desired. Suitable techniques may include inspection and measurement of individual particles, as well as using automated image analysis techniques (e.g., using a dynamic image analyzer such as a CAMSIZER XT image analyzer from Retsch Technology Gmbh of Haan, Germany) according to test method ISO 13402-2:2006 "Particle size analysis—Image analysis methods—Part 2: Dynamic image analysis methods".

According to one embodiment of the present disclosure, coated abrasive articles can be made according to the following method comprising the following sequential steps, which in some embodiments are consecutive steps.

In a first step, a curable make layer precursor is deposited on a major surface of a backing as described herein above. Coating may be accomplished by any suitable method including, for example, spray coating, curtain coating, slot coating, roll coating, and/or knife coating. Coating weights will depend on the application, and will be apparent to those of skill in the art.

In a second step, agglomerate grinding aid particles, preferably shaped agglomerate grinding aid particles, are deposited onto the curable make layer precursor. They may be deposited by any suitable method including, for example, drop coating, robotic placement, and electrostatic coating. In some preferred embodiments, at least some of the agglomerate grinding aid particles can be deposited according to a predetermined pattern. Examples of patterns include rectangular grids, parallel stripes, hexagonal grids, parallel wavy lines, checkerboard, spiral, and an array of partially-filled circles. As used herein, the term "pattern" refers to the overall pattern formed by the agglomerate grinding aid particles, not to the individual agglomerate grinding aid particles that make up the pattern. In general, the coating density of the agglomerate grinding aid particles should be sufficiently light that the resulting coated areas and pattern are open, thereby allowing abrasive particles to be coated immediately adjacent to the agglomerate grinding aid particles. In this way, their orientation will be affected by the agglomerate grinding aid particles; for example, as discussed hereinbefore.

In a third step, the abrasive particles are deposited on to the curable make layer precursor such that at least a portion of them are disposed in spaces between the agglomerate grinding aid particles. Any suitable technique for depositing abrasive particles may be used.

In a fourth step, the curable make layer precursor is sufficiently cured (e.g., using heat and/or electromagnetic radiation) that the agglomerate grinding aid particles and the abrasive particles are secured to the backing for application of the curable size layer precursor.

In a fifth step, a curable size layer precursor onto at least a portion of the agglomerate grinding aid particles, abrasive particles, and at least partially cured make layer precursor. Coating may be accomplished by any suitable method including, for example, spray coating, curtain coating, slot coating, roll coating, and/or knife coating. Coating weights will depend on the application, and will be apparent to those of skill in the art.

In a sixth step, the curable size layer precursor is cured; for example, using heat and/or electromagnetic radiation.

Optionally, coated abrasive articles may further comprise, for example, a backsize (that is, a coating on the major surface of the backing opposite the major surface having the abrasive coat), a presize or a tie layer (that is, a coating between the abrasive coat and the major surface to which the abrasive coat is secured), and/or a saturant which coats both major surfaces of the backing. Coated abrasive articles may further comprise a supersize covering the abrasive coat. If present, the supersize typically includes grinding aids and/or anti-loading materials.

Further description of techniques and materials for making coated abrasive articles may be found in, for example, U.S. Pat. No. 4,314,827 (Leitheiser et al.); U.S. Pat. No. 4,518,397 (Leitheiser et al.); U.S. Pat. No. 4,623,364 (Cottringer et al.); U.S. Pat. No. 4,652,275 (Bloecher et al.); U.S. Pat. No. 4,734,104 (Broberg); U.S. Pat. No. 4,737,163 (Larkey); U.S. Pat. No. 4,744,802 (Schwabel); U.S. Pat. No. 4,770,671 (Monroe et al.); U.S. Pat. No. 4,799,939 (Bloecher et al.); U.S. Pat. No. 4,881,951 (Wood et al.); U.S. Pat. No. 4,927,431 (Buchanan et al.); U.S. Pat. No. 5,498,269 (Larmie); U.S. Pat. No. 5,011,508 (Wald et al.); U.S. Pat. No. 5,078,753 (Broberg et al.); U.S. Pat. No. 5,090,968 (Pellow); U.S. Pat. No. 5,108,463 (Buchanan et al.); U.S. Pat. No. 5,137,542 (Buchanan et al.); U.S. Pat. No. 5,139,978 (Wood); U.S. Pat. No. 5,152,917 (Pieper et al.); U.S. Pat. No. 5,203,884 (Buchanan et al.); U.S. Pat. No. 5,227,104 (Bauer); and U.S. Pat. No. 5,328,716 (Buchanan).

Coated abrasive articles made according to the methods of present disclosure are useful, for example, for abrading a workpiece. Examples of workpiece materials include metal, metal alloys, exotic metal alloys, ceramics, glass, wood, wood-like materials, composites, painted surfaces, plastics, reinforced plastics, stone, and/or combinations thereof. The workpiece may be flat or have a shape or contour associated with it. Exemplary workpieces include metal components, plastic components, particleboard, camshafts, crankshafts, furniture, and turbine blades. The applied force during abrading typically ranges from about 1 kilogram to about 100 kilograms.

Coated abrasive articles made according to the methods of present disclosure may be used by hand and/or used in combination with a machine. At least one of the coated abrasive article and the workpiece is moved relative to the other when abrading. Abrading may be conducted under wet or dry conditions. Exemplary liquids for wet abrading include water, water containing conventional rust inhibiting compounds, lubricant, oil, soap, and cutting fluid. The liquid may also contain defoamers, degreasers, for example.

Select Embodiments of the Present Disclosure

In a first aspect, the present disclosure provides a coated abrasive article comprising:

a backing having first and second opposed major surfaces;

a make layer bonded to the first major surface;

agglomerate grinding aid particles directly bonded to the make layer, wherein the agglomerate grinding aid particles comprise grinding aid particles retained in a binder, and wherein at least a portion of the agglomerate grinding aid particles are arranged according to an open predetermined pattern;

abrasive particles directly bonded to the make layer, wherein the abrasive particles are disposed in spaces between the agglomerate grinding aid particles;

a size layer directly bonded to the make layer, agglomerate grinding aid particles, and abrasive particles.

In a second embodiment, the present disclosure provides a coated abrasive article according to the first embodiment, wherein the agglomerate grinding aid particles are shaped.

In a third embodiment, the present disclosure provides a coated abrasive article according to the first or second embodiment, wherein the agglomerate grinding aid particles are precisely-shaped.

In a fourth embodiment, the present disclosure provides a coated abrasive article according to the second or third embodiment, wherein at least 50% of the agglomerate grinding aid particles are individually positioned such that an acute angle is formed between at least one sidewall of a respective agglomerate grinding aid particle and the backing.

In a fifth embodiment, the present disclosure provides a coated abrasive article according to any one of the first to fourth embodiments, wherein the abrasive particles are shaped.

In a sixth embodiment, the present disclosure provides a coated abrasive article according to any one of the first to fifth embodiments, wherein the abrasive particles are precisely-shaped.

In a seventh embodiment, the present disclosure provides a coated abrasive article according to any one of the first to sixth embodiments, wherein the agglomerate grinding aid particles are free of abrasive particles.

In an eighth embodiment, the present disclosure provides a coated abrasive article according to any one of the first to seventh embodiments, wherein the ratio of the length of the abrasive particles to the height of agglomerate grinding aid particles is between 1:2 and 2:1.

In a ninth embodiment, the present disclosure provides a coated abrasive article according to any one of the first to eighth embodiments, wherein the agglomerate grinding aid particles and abrasive particle are present in sufficient quantity to form a closed coat.

In a tenth embodiment, the present disclosure provides a method of making a coated abrasive article, the method comprising sequentially:

depositing a curable make layer precursor on a major surface of a backing;

depositing agglomerate grinding aid particles onto the curable make layer precursor, wherein the agglomerate grinding aid particles comprise grinding aid particles retained in a binder;

depositing abrasive particles onto the curable make layer precursor, wherein the abrasive particles are disposed in spaces between the agglomerate grinding aid particles;

at least partially curing the curable make layer precursor to provide an at least partially cured make layer precursor;

depositing a curable size layer precursor onto at least a portion of the agglomerate grinding aid particles, abrasive particles, and at least partially cured make layer precursor; and at least partially curing the curable size layer precursor.

In an eleventh embodiment, the present disclosure provides a method of making a coated abrasive article according to the eighth embodiment, wherein the agglomerate grinding aid particles are deposited on the curable make layer precursor according to an open predetermined pattern.

In a twelfth embodiment, the present disclosure provides a method of making a coated abrasive article according to the tenth or eleventh embodiment, wherein the agglomerate grinding aid particles are shaped.

In a thirteenth embodiment, the present disclosure provides a method of making a coated abrasive article according to any one of the tenth to twelfth embodiments, wherein the agglomerate grinding aid particles are precisely-shaped.

In a fourteenth embodiment, the present disclosure provides a method of making a coated abrasive article according to the twelfth or thirteenth embodiment, wherein at least 50% of the agglomerate grinding aid particles are individually positioned such that an acute angle is formed between at least one sidewall of a respective agglomerate grinding aid particle and the backing.

In a fifteenth embodiment, the present disclosure provides a method of making a coated abrasive article according to any one of the tenth to fourteenth embodiments, wherein the abrasive particles are shaped.

In a sixteenth embodiment, the present disclosure provides a method of making a coated abrasive article according to any one of the tenth to fifteenth embodiments, wherein the abrasive particles are precisely-shaped.

In a seventeenth embodiment, the present disclosure provides a method of making a coated abrasive article according to any one of the tenth to sixteenth embodiments, wherein the agglomerate grinding aid particles are free of abrasive particles.

In an eighteenth embodiment, the present disclosure provides a method of making a coated abrasive article according to any one of the tenth to seventeenth embodiments, wherein the ratio of the length of the abrasive particles to the height of agglomerate grinding aid particles is between 1:2 and 2:1.

Objects and advantages of this disclosure are further illustrated by the following non-limiting examples, but the particular materials and amounts thereof recited in these examples, as well as other conditions and details, should not be construed to unduly limit this disclosure.

EXAMPLES

Unless otherwise noted, all parts, percentages, ratios, etc. in the Examples and the rest of the specification are by weight.

Unless stated otherwise, all other reagents were obtained, or are available from fine chemical vendors such as Sigma-Aldrich Company, St. Louis, Missouri, or may be synthesized by known methods.

Unit Abbreviations used in the Examples: ° C.=degree Celsius; cm=centimeter; μm=micron.

Materials used in the Examples are reported in Table 1, below:

| | |
|---|---|
| KBF4 | Potassium tetrafluoroborate, obtained under the trade designation POTASSIUM FLUOROBORATE SPEC 101 from Atotech USA, Inc., Rockhill, South Carolina. |
| ER1 | Aqueous epoxy dispersion commercially available as EPI-REZ 3522-W60 from Hexion Specialty Chemical, Inc., Louisville, Kentucky. |
| EC1 | 2-Ethyl-4-methyl imidazole, obtained as EMI-2,4 from Air Products, Allentown, Pennsylvania. |
| TRE | Tackifier resin emulsion, available as SURETAC 1585 from Dyna Tech Adhesives, Inc., Grafton, Wyoming. |
| CB | Aqueous carbon black dispersion, available as KW3729 AQUIS CARBON BLACK from Heucotech Ltd., Fairless Hills, Pennsylvania. |
| IO | Red iron oxide pigment, obtained as KROMA RO-3097 from Elementis Specialties, Inc., East Saint Louis, Illinois. |
| SS1 | Suspension 1, prepared by mixing 15 parts by weight of ER1, 11 parts by weight of TRE, 66 parts by weight of KBF4, 2 parts by weight of CB, 0.5 parts by weight of EC1 and 5.5 parts by weight of deionized water. |
| SS2 | Suspension 2, prepared by mixing 30 parts by weight of ER1, 55 parts by weight of KBF4, 2 parts by weight of IO, 0.5 parts by weight of EC1 and 12.5 parts by weight of deionized water. |
| GA1 | Grinding-aid agglomerates 1, produced though a molding process described in U.S. Patent No. 6,582,487 (Larson et al.) using SS1. The agglomerates were in truncated pyramid shape with a smaller square top face (about 600 μm by 600 μm) and larger square bottom face (about 800 μm by 800 μm), and the side length is about 650 μm. |
| GA2 | Grinding-aid agglomerates 2, produced generally according to the process of making GA1 with exception that SS2 was used instead of SS1. The shape and dimensions of the resulting agglomerates were generally the same as of GAl. |
| SAP | Shaped abrasive particles, prepared according to the disclosure of U.S. Pat. No. 8,142,531 (Adefris et al.). The SAP used in the examples were about 850 μm (side length) × 155 μm (thickness), with a draft angle approximately 98 degrees. |
| VFB | Vulcanized fiber backing, about 0.85 mm thick, 1100 gram per square meter available as DYNOS VULCANIZED FIBRE from Dynos GmbH, Germany. |
| PR1 | Phenol-formaldehyde resin having a phenol to formaldehyde molar ratio of 1:1.5-2.1, and catalyzed with 2.5 percent by weight potassium hydroxide. |
| CACO | Calcium carbonate commercially available as HUBERCARB Q325 from Hubercarb Engineered Materials, Atlanta Georgia. |
| SCM | Surface-treated calcium metasilicate available as WOLLASTOCOAT 400 from NYCO Mineral, Willsboro, New York. |
| MR1 | Phenolic make resin 1, prepared by mixing 49 parts by weight of PR1, 41 parts by weight of CACO, and 10 parts by weight of deionized water. |
| MR2 | Phenolic make resin 2, prepared by mixing 52 parts by weight of PRI, 42 parts by weight of SCM, and 6 parts by weight of deionized water. |
| SR1 | Phenolic size resin 1, prepared by mixing 40.6 parts by weight of PRI, 69.9 parts by weight of CRY, 2.5 parts by weight IO, and 25 parts by weight deionized water. |
| YFB | Polyester backing described in Example 12 of U.S. Pat. No. 6,843,815 (Thurber et al.) |
| MGT | Grain orientation tooling described in Example 1 in Pat. Publication No. WO2016205133 (Wilson et al.) |

Example 1

This example was made through the following steps: (1) VFB was die-cut into 7-inch (17.8-cm) diameter disc with ⅞-inch (2.22-cm) diameter center hole; (2) 4.5 grams of MR1 was coated on the VFB disc uniformly; (3) 5.8 grams of GA1 were drop coated on the MR1 layer through a No. 19 mesh (U.S.A. Standard Test Sieves conforming to ASTM E-11 "Standard Specification for Wire Cloth and Sieves for Testing Purposes"); (4) 4.0 grams of SAP were coated on the MR1 layer by traditional electrostatic coating; (5) the disc was taken into an oven for precure at 90° C. for 45 minutes, 105° C. for 3 hours; (6) 13 grams of SR1 was uniformly coated on the top of the grain layer; (7) the whole disc was taken into an oven for precure at 90° C. for 45 minutes, 105° C. for 12 hours.

Example 2

EXAMPLE 2 was made generally according to the procedure described in EXAMPLE 1 except for step (3). In EXAMPLE 2, 5.8 grams GA1 were randomly drop coated on the MR1 layer, without any mesh used.

Comparative Example A

This sample was made through the following steps: (1) VFB was die-cut into 7-inch (17.8-cm) diameter disc with ⅞-inch (2.22-cm) diameter center hole; (2) 4.5 grams of MR1 was coated on the VFB disc uniformly; (3) 4.0 grams of SAP are electrostatically coated on the MR1 layer; (4) the whole disc was taken into an oven for precure at 90° C. for 45 minutes, 105° C. for 3 hours; (5) 6.5 grams of SR1 was uniformly coated on the top of the grain layer; (6) the whole disc was taken into an oven for precure at 90° C. for 45 minutes, 105° C. for 3 hours; (7) 6 grams of SS2 was uniformly coated on the top of the size layer; (8) the whole disc is taken into an oven for precure at 90° C. for 45 minutes, 105° C. for 12 hours.

Comparative Example B

This sample was made through the following steps: (1) VFB was die-cut into 7-inch (17.8-cm) diameter disc with ⅞-inch (2.22-cm) diameter center hole; (2) 4.5 grams of MR1 was coated on the VFB disc uniformly; (3) 4.0 grams of SAP were electrostatically coated on the MR1 layer; (4) 5.8 grams of GA1 were randomly drop coated on the MR1 layer; (5) the whole disc was taken into an oven for precure at 90° C. for 45 minutes, 105° C. for 3 hours; (6) 13 grams of SR1 was uniformly coated on the top of the grain layer; (7) the whole disc was taken into an oven for precure at 90° C. for 45 minutes, 105° C. for 12 hours.

Example 3

This sample was made through the following steps: (1) MR2 was coated on 4-inch wide YFB with a coating knife to control the caliper at 10 mil (0.0254 cm); (2) GA2 were drop coated on the MR2 make layer though a MGT, and the coating weight was 0.625 grain per square inch (62.8 grams per square meter); (3) SAP were electrostatically coated on the MR2 layer, and the coating weight was about 4.58 grains per square inch (460.0 grams per square meter); (4) the belt was taken into an oven for precure at 90° C. for 1 minutes, 105° C. for 2 hours; (5) 40 grams of SR1 was uniformly coated on the top of the mineral layer; (6) the belt was taken into an oven for precure at 90° C. for 1 minutes, 105° C. for 2 hours; (7) 20 grams of SS2 was uniformly coated on the top of the size layer; (8) the belt was taken into an oven for precure at 90° C. for 45 minutes, 105° C. for 12 hours.

Example 4

The sample was made generally according to the procedure described in EXAMPLE 3 except that steps (6) and (7) were not applied.

Comparative Example C

This example was made through the following steps: (1) MR2 was coated on 4-inch wide YFB with a coating knife to control the caliper at 10 mil (0.0254 cm); (2) SAP were electrostatically coated on the MR2 layer, and the coating weight is about 4.58 grains per square inch (460.0 grams per square meter); (3) the belt was taken into an oven for precure at 90° C. for 1 minutes, 105° C. for 2 hours; (4) 40 grams of SR1 was uniformly coated on the top of the grain layer; (5) the belt was taken into an oven for precure at 90° C. for 1 minutes, 105° C. for 2 hours; (6) 20 grams of SS2 was uniformly coated on the top of the size layer; (7) the belt was taken into an oven for precure at 90° C. for 45 minutes, 105° C. for 12 hours.

Comparative Example D

The sample was made generally according to the procedure described in COMPARATIVE EXAMPLE C except that steps (6) and (7) were not applied.

Performance Test

Samples made from EXAMPLES 1-2 and COMPARATIVE EXAMPLES A-B were tested with consistent torque control (set up at 3.4 amps). For each test, a 304 stainless steel bar measured 1-inch (2.54-cm) by 1-inch (2.54-cm) was used as the test substrate (workpiece) with the surface to be abraded. The disc sample (7-inch (17.8-cm) diameter disc with ⅞-inch (2.22-cm) diameter center hole) was installed on a disc grinder together with a 7-inch Extra Hard Red Ribbed back-up pad (available from 3M Company, St. Paul, Minnesota). The disc was run at 5000 revolutions per minute (rpm). The workpiece was pressed into the disc and moved from near-center (about 6.35 cm from the center) to the edge for four passes, and then near the end of the grind time it was swung back and forth quickly against the edge of the disc. This grinding process took 15 seconds, which was defined as one cycle. The workpiece was then cooled and tested again. The cut (the weight loss of the workpiece after an individual cycle) and the cumulative cut (the cumulative weight loss of the workpiece) in grams was recorded after each cycle. The end point of the test was 50 cycles or when the cut of an individual cycle dropped below 5 grams. The test results (cumulative cut in grams) for EXAMPLES 1-2 and COMPARATIVE EXAMPLES A-B are shown in TABLE 2, below.

| | CUMULATIVE CUT, grams | | | |
|---|---|---|---|---|
| CYCLES | Example 1 | Example 2 | Comparative Example A | Comparative Example B |
| 1 | 14.10 | 9.89 | 20.04 | 2.84 |
| 2 | 31.73 | 25.61 | 36.54 | |
| 3 | 48.43 | 40.43 | 50.12 | |
| 4 | 62.70 | 54.71 | 62.06 | |
| 5 | 76.66 | 69.20 | 74.74 | |
| 6 | 90.50 | 84.11 | 86.82 | |

-continued

| | CUMULATIVE CUT, grams | | | |
|---|---|---|---|---|
| CYCLES | Example 1 | Example 2 | Comparative Example A | Comparative Example B |
| 7 | 105.01 | 98.02 | 98.17 | |
| 8 | 118.81 | 111.97 | 109.44 | |
| 9 | 133.81 | 125.78 | 120.25 | |
| 10 | 147.72 | 138.84 | 130.59 | |
| 11 | 161.44 | 152.21 | 140.79 | |
| 12 | 174.45 | 165.61 | 150.15 | |
| 13 | 186.80 | 178.64 | 159.51 | |
| 14 | 199.99 | 191.79 | 168.75 | |
| 15 | 213.55 | 204.88 | 177.93 | |
| 16 | 227.01 | 218.28 | 186.77 | |
| 17 | 240.03 | 231.49 | 194.9 | |
| 18 | 253.37 | 244.84 | 202.93 | |
| 19 | 266.19 | 257.90 | 210.77 | |
| 20 | 278.53 | 270.1 | 218.38 | |
| 21 | 290.70 | 281.90 | 226.13 | |
| 22 | 302.81 | 293.45 | 233.31 | |
| 23 | 314.83 | 304.71 | 240.28 | |
| 24 | 327.67 | 316.26 | 246.64 | |
| 25 | 339.86 | 327.76 | 252.67 | |
| 26 | 352.15 | 339.92 | 258.33 | |
| 27 | 364.36 | 351.07 | | |
| 28 | 376.14 | 361.18 | | |
| 29 | 387.82 | 370.99 | | |
| 30 | 399.33 | 380.71 | | |
| 31 | 410.51 | 390.32 | | |
| 32 | 421.62 | 399.67 | | |
| 33 | 432.65 | 408.65 | | |
| 34 | 442.98 | 417.47 | | |
| 35 | 452.91 | 425.92 | | |
| 36 | 462.92 | 434.19 | | |
| 37 | 472.56 | 442.27 | | |
| 38 | 482.40 | 449.90 | | |
| 39 | 491.67 | 457.51 | | |
| 40 | 500.66 | 464.78 | | |
| 41 | 509.35 | 471.62 | | |
| 42 | 517.89 | 478.37 | | |
| 43 | 526.11 | 485.34 | | |
| 44 | 534.26 | 492.02 | | |
| 45 | 542.42 | 498.79 | | |
| 46 | 550.54 | 505.41 | | |
| 47 | 558.22 | 511.72 | | |
| 48 | 565.63 | 518.08 | | |
| 49 | 572.82 | 524.16 | | |
| 50 | 579.76 | 530.09 | | |

The performance test was conducted on 10.16-cm by 91.44-cm belts converted from samples made from EXAMPLES 3-4 and COMPARATIVE EXAMPLES C-D. The workpiece was a 304 stainless steel bar on which the surface to be abraded measured 1.9 cm by 1.9 cm. A 20.3 cm diameter 70 durometer rubber, 1:1 land to groove ratio, serrated contact wheel was used. The belt was run at 2750 rpm. The workpiece was applied to the center part of the belt at a normal force 45 newton. The test consisted of measuring the weight loss of the workpiece after 15 seconds of grinding, which was defined as one cycle. The workpiece was then cooled and tested again. The cut (the weight loss of the workpiece after an individual cycle) and the cumulative cut (the cumulative weight loss of the workpiece) in grams was recorded after each cycle. The test was concluded after 100 cycles or when the cut of an individual cycle dropped below 10% of the cut of the first cycle. The test results for EXAMPLES 3-4 and COMPARATIVE EXAMPLES C-D are shown in TABLE 3, below.

| CYCLES | CUMULATIVE CUT, grams | | | |
|---|---|---|---|---|
| | Example 3 | Example 4 | Comparative Example C | Comparative Example D |
| 1 | 14.29 | 22.91 | 29.51 | 28.59 |
| 2 | 34.04 | 48.64 | 57.75 | 52.22 |
| 3 | 54.25 | 73.82 | 85.39 | 71.68 |
| 4 | 74.35 | 98.25 | 112.47 | 87.86 |
| 5 | 94.06 | 122.62 | 138.46 | 102.24 |
| 6 | 113.57 | 146.37 | 163.60 | 114.96 |
| 7 | 133.00 | 169.50 | 188.02 | 126.5 |
| 8 | 152.40 | 192.28 | 211.49 | 137.06 |
| 9 | 171.47 | 214.11 | 234.58 | 147.28 |
| 10 | 190.48 | 235.59 | 256.86 | 156.95 |
| 11 | 209.36 | 256.48 | 278.85 | 165.91 |
| 12 | 227.96 | 276.76 | 300.23 | 174.02 |
| 13 | 246.22 | 296.91 | 321.43 | 181.91 |
| 14 | 264.56 | 316.92 | 342.57 | 189.41 |
| 15 | 282.68 | 336.53 | 362.93 | 196.44 |
| 16 | 300.44 | 355.56 | 383.16 | 203.17 |
| 17 | 317.77 | 374.08 | 402.92 | 209.74 |
| 18 | 335.06 | 392.40 | 422.38 | 216.12 |
| 19 | 352.25 | 410.46 | 441.82 | 222.43 |
| 20 | 369.08 | 428.31 | 460.66 | 228.34 |
| 21 | 385.99 | 445.92 | 479.14 | 234.00 |
| 22 | 402.74 | 463.15 | 496.92 | 239.38 |
| 23 | 419.16 | 480.02 | 514.43 | 244.6 |
| 24 | 435.54 | 496.39 | 531.58 | 249.71 |
| 25 | 452.02 | 512.71 | 548.37 | 254.64 |
| 26 | 468.51 | 528.81 | 564.70 | 259.35 |
| 27 | 485.14 | 544.16 | 580.65 | 263.94 |
| 28 | 501.69 | 559.23 | 596.18 | 268.34 |
| 29 | 518.21 | 573.94 | 611.09 | 272.69 |
| 30 | 534.46 | 588.36 | 625.46 | 276.92 |
| 31 | 550.48 | 602.66 | 639.69 | 281.05 |
| 32 | 566.20 | 616.72 | 653.58 | 285.04 |
| 33 | 581.75 | 630.45 | 666.94 | 288.92 |
| 34 | 597.21 | 643.98 | 679.88 | 292.68 |
| 35 | 612.74 | 657.53 | 692.79 | 296.31 |
| 36 | 628.23 | 671.12 | 705.14 | 299.83 |
| 37 | 643.67 | 684.37 | 717.09 | 303.29 |
| 38 | 659.01 | 697.64 | 728.75 | 306.68 |
| 39 | 674.29 | 710.76 | 740.09 | 309.95 |
| 40 | 689.27 | 723.90 | 751.32 | 313.20 |
| 41 | 704.36 | 736.67 | 762.15 | |
| 42 | 719.46 | 748.94 | 772.61 | |
| 43 | 734.32 | 761.08 | 782.73 | |
| 44 | 748.98 | 772.96 | 792.59 | |
| 45 | 763.56 | 784.67 | 802.10 | |
| 46 | 778.18 | 796.28 | 811.04 | |
| 47 | 792.48 | 807.71 | 819.98 | |
| 48 | 806.73 | 819.12 | 828.7 | |
| 49 | 821.03 | 830.34 | 837.31 | |
| 50 | 835.08 | 841.52 | 845.74 | |
| 51 | 849.03 | 852.35 | 854.01 | |
| 52 | 862.96 | 862.87 | 861.89 | |
| 53 | 876.56 | 873.42 | 869.71 | |
| 54 | 889.97 | 883.8 | 877.38 | |
| 55 | 903.32 | 893.97 | 884.96 | |
| 56 | 916.48 | 903.96 | 892.31 | |
| 57 | 929.49 | 913.8 | 899.55 | |
| 58 | 942.54 | 923.55 | 906.60 | |
| 59 | 955.65 | 933.18 | 913.41 | |
| 60 | 968.70 | 942.75 | 920.12 | |
| 61 | 981.73 | 952.15 | 926.6 | |
| 62 | 994.70 | 961.38 | 932.94 | |
| 63 | 1007.45 | 970.56 | 939.23 | |
| 64 | 1020.12 | 979.66 | 945.33 | |
| 65 | 1032.71 | 988.61 | 951.18 | |
| 66 | 1045.24 | 997.44 | 956.94 | |
| 67 | 1057.50 | 1006.20 | 962.60 | |
| 68 | 1069.50 | 1014.90 | 968.01 | |
| 69 | 1081.30 | 1023.48 | 973.27 | |
| 70 | 1093.01 | 1031.89 | 978.47 | |
| 71 | 1104.54 | 1039.96 | 983.56 | |
| 72 | 1116.05 | 1047.95 | 988.55 | |
| 73 | 1127.59 | 1055.93 | 993.42 | |
| 74 | 1139.14 | 1063.89 | 998.14 | |
| 75 | 1150.56 | 1071.71 | 1002.7 | |
| 76 | 1161.72 | 1079.39 | 1007.14 | |

-continued

| CYCLES | CUMULATIVE CUT, grams | | | |
|---|---|---|---|---|
| | Example 3 | Example 4 | Comparative Example C | Comparative Example D |
| 77 | 1172.75 | 1087.08 | 1011.54 | |
| 78 | 1183.70 | 1094.60 | 1015.88 | |
| 79 | 1194.62 | 1101.92 | 1020.1 | |
| 80 | 1205.61 | 1109.16 | 1024.28 | |
| 81 | 1216.58 | 1116.41 | 1028.30 | |
| 82 | 1227.24 | 1123.61 | 1032.24 | |
| 83 | 1237.60 | 1130.71 | 1036.12 | |
| 84 | 1247.96 | 1137.69 | 1039.93 | |
| 85 | 1258.28 | 1144.53 | 1043.66 | |
| 86 | 1268.55 | 1151.25 | 1047.31 | |
| 87 | 1278.83 | 1157.97 | 1050.96 | |
| 88 | 1288.93 | 1164.59 | 1054.50 | |
| 89 | 1299.00 | 1171.16 | 1058.01 | |
| 90 | 1309.00 | 1177.66 | 1061.45 | |
| 91 | 1318.84 | 1184.06 | 1064.89 | |
| 92 | 1328.55 | 1190.43 | 1068.22 | |
| 93 | 1338.09 | 1196.70 | 1071.53 | |
| 94 | 1347.63 | 1202.90 | 1074.76 | |
| 95 | 1357.05 | 1209.02 | 1077.93 | |
| 96 | 1366.31 | 1215.14 | 1081.09 | |
| 97 | 1375.47 | 1221.20 | 1084.21 | |
| 98 | 1384.57 | 1227.10 | 1087.20 | |
| 99 | 1393.72 | 1232.89 | 1090.18 | |
| 100 | 1402.82 | 1238.73 | 1093.12 | |

All cited references, patents, and patent applications in this application that are incorporated by reference, are incorporated in a consistent manner. In the event of inconsistencies or contradictions between portions of the incorporated references and this application, the information in the this application shall control. The preceding description, given in order to enable one of ordinary skill in the art to practice the claimed disclosure, is not to be construed as limiting the scope of the disclosure, which is defined by the claims and all equivalents thereto.

What is claimed is:

1. A coated abrasive article comprising:

a backing having first and second opposed major surfaces;

a make layer bonded to the first major surface;

agglomerate grinding aid particles directly bonded to the make layer, wherein the agglomerate grinding aid particles comprise grinding aid particles retained in a binder, and wherein at least a portion of the agglomerate grinding aid particles are arranged according to an open predetermined pattern comprising a rectangular grid, parallel stripes, a hexagonal grid, parallel wavy lines, a checkerboard pattern, a spiral pattern, or an array of partially-filled circles;

abrasive particles directly bonded to the make layer, wherein the abrasive particles are disposed in spaces between the agglomerate grinding aid particles; and a size layer directly bonded to the make layer, agglomerate grinding aid particles, and abrasive particles.

2. The coated abrasive article of claim 1, wherein the agglomerate grinding aid particles are shaped.

3. The coated abrasive article of claim 2, wherein the agglomerate grinding aid particles are precisely shaped.

4. The coated abrasive article of claim 2, wherein at least 50% of the agglomerate grinding aid particles are individually positioned such that an acute angle is formed between at least one sidewall of a respective agglomerate grinding aid particle and the backing.

5. The coated abrasive article of claim 1, wherein the abrasive particles are shaped.

6. The coated abrasive article of claim 5, wherein the abrasive particles are precisely shaped.

7. The coated abrasive article of claim 1, wherein the agglomerate grinding aid particles are free of abrasive particles.

8. The coated abrasive article of claim 1, wherein the ratio of the length of the abrasive particles to the height of agglomerate grinding aid particles is between 1:2 and 2:1.

9. The coated abrasive article of claim 1, wherein the agglomerate grinding aid particles and abrasive particle are present in sufficient quantity to form a closed coat.

10. A method of making a coated abrasive article, the method comprising sequentially:

depositing a curable make layer precursor on a major surface of a backing;

depositing agglomerate grinding aid particles onto the curable make layer precursor, wherein the agglomerate grinding aid particles comprise grinding aid particles retained in a binder and wherein the agglomerate grinding aid particles are deposited on the curable make layer precursor according to an open predetermined pattern comprising a rectangular grid, parallel stripes, a hexagonal grid, parallel wavy lines, a checkerboard pattern, a spiral pattern, or an array of partially-filled circles;

depositing abrasive particles onto the curable make layer precursor, wherein the abrasive particles are disposed in spaces between the agglomerate grinding aid particles;

at least partially curing the curable make layer precursor to provide an at least partially cured make layer precursor;

depositing a curable size layer precursor onto at least a portion of the agglomerate grinding aid particles, abrasive particles, and at least partially cured make layer precursor; and at least partially curing the curable size layer precursor.

11. The method of claim 10, wherein the agglomerate grinding aid particles are shaped.

12. The method of claim 11, wherein the agglomerate grinding aid particles are precisely shaped.

13. The method of claim 11, wherein at least 50% of the agglomerate grinding aid particles are individually positioned such that an acute angle is formed between at least one sidewall of a respective agglomerate grinding aid particle and the backing.

14. The method of claim 10, wherein the abrasive particles are shaped.

15. The method of claim 14, wherein the abrasive particles are precisely shaped.

16. The method of claim 10, wherein the agglomerate grinding aid particles are free of abrasive particles.

17. The method of claim 10, wherein the ratio of the length of the abrasive particles to the height of agglomerate grinding aid particles is between 1:2 and 2:1.

* * * * *